United States Patent [19]

Kulieke, Jr.

[11] 4,445,618

[45] May 1, 1984

[54] SPRING BIASED ROTARY RAILWAY CAR COUPLER CARRIER

[75] Inventor: Frederick C. Kulieke, Jr., Tallmadge, Ohio

[73] Assignee: Midland-Ross Corporation, Cleveland, Ohio

[21] Appl. No.: 335,828

[22] Filed: Dec. 30, 1981

[51] Int. Cl.[3] ..... B61G 5/00; B61G 7/10; B61G 9/22

[52] U.S. Cl. ..... 213/61; 213/60; 213/62 A

[58] Field of Search ..... 213/58, 59, 50, 60, 213/61, 62 A

[56] References Cited

U.S. PATENT DOCUMENTS

| | | | |
|---|---|---|---|
| 2,604,215 | 7/1952 | Kayler | 213/60 |
| 3,417,876 | 12/1968 | Stretch et al. | 213/60 |
| 4,105,128 | 8/1978 | Spencer | 213/61 |
| 4,344,541 | 8/1982 | Chierici | 213/61 |

*Primary Examiner*—Robert B. Reeves
*Assistant Examiner*—Howard Beltran
*Attorney, Agent, or Firm*—Harlan E. Hummer

[57] ABSTRACT

A rotary railroad car coupler assembly is described as having a unique carrier which is designed for limited angling or tilting in the vertically elongated chamber of the striker, as the coupler rotates. The projecting lugs of the carrier which interlockingly engage the stops in the chamber of the striker, have sloping sides which diverge from the sidewalls of the chamber in a direction away from the coupler, rather than being parallel to the sidewalls as are the sides of the lugs of AAR Standard carriers. This improvement eliminates chattering that is normally occasioned when AAR Standard carriers are used in connection with a rotary railroad car coupler assembly and helps to prevent undue stress of the striker caused when the carrier becomes momentarily frozen or bound up in the striker as the coupler rotates.

5 Claims, 3 Drawing Figures

2
2

SPRING BIASED ROTARY RAILWAY CAR COUPLER CARRIER

BACKGROUND OF THE INVENTION

The invention is particularly well suited for use in a rotary railroad car coupler assembly, although it can be used equally well in railroad car coupler assemblies of the non-rotary type.

Those skilled in the art of designing rotary railroad car coupler assemblies know that as the car coupler rotates, the shank of the coupler eccentrically imparts against the carrier, forces which cause the carrier to tilt within the chamber of the striker provided for receipt of the carrier and the coil springs for spring loading the carrier, thereby impeding the depression of the carrier in the chamber and causing undesirable chattering of the carrier as it tries to move downwardly in the chamber. Also, the temporary binding of the carrier within the chamber places undue stress against the striker. The invention is directed to solving this problem by the provision of an improved carrier which is specifically designed for limited angling or tilting to accommodate the rotation of the car coupler, whereby the carrier operates more smoothly.

Briefly stated, the invention is in a railroad car coupler assembly which comprises a yoke and a car coupler that includes a coupler head with an attached shank that extends from the head into the yoke. A mounting assembly is provided for mounting the butt end of the shank within the yoke. The assembly includes a striker which has a portion thereof designed to receive a spring loaded carrier that engages the coupler shank between the coupler head and the butt end of the shank to support the head. The striker portion has a chamber that is defined between a pair of opposing, vertically disposed sidewalls that have a pair of oppositely aligned stops which extend horizontally into the chamber from the sidewalls, when the yoke and coupler are in a normal horizontal operating position. The carrier, as well as the springs for resiliently loading the carrier, are received in the chamber of the striker portion. The carrier includes a pair of oppositely extending and horizontally aligned lugs for interlockingly engaging the stops to maintain the carrier within the chamber. The lugs have adjacent the vertical sidewalls of the striker portion, sloping sides which confront the sidewalls and converge in a direction away from the coupler shank. The sides of the carrier are sufficiently sloped to allow simultaneous depression and limited angling or tilting of the carrier within the chamber during rotation of the car coupler.

AAR Standard carriers have lugs with parallel sides that are, in turn, parallel to the sidewalls of the chamber and not sloped, as described above. It can be appreciated that the provision of sloping sides on the carrier does not adversely affect normal depression or operation of the carrier when used in conjunction with a non-rotary-type railroad car coupler assembly.

DESCRIPTION OF THE DRAWING

The following description of the invention will be better understood by having reference to the accompanying drawing, wherein.

ENVIRONMENT OF THE INVENTION

Figure 1:
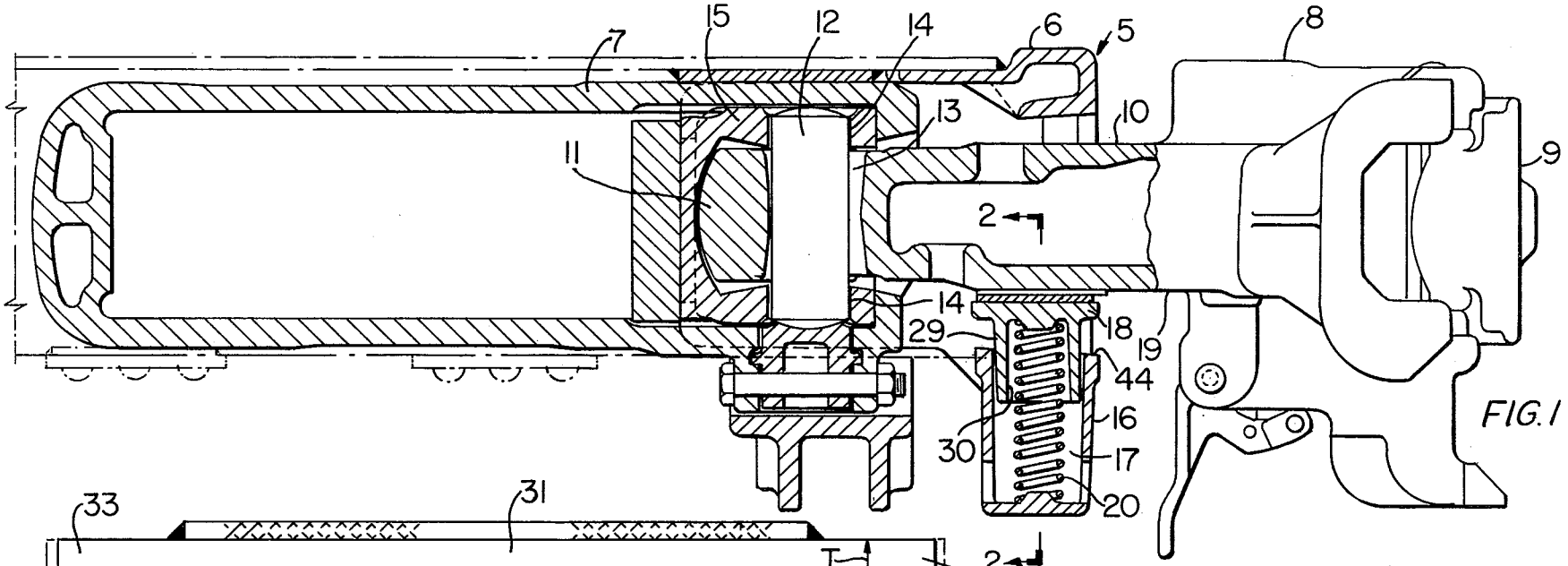
FIG. 1 is a side view of an F-type rotary railroad car coupler assembly which is made in accordance with the invention and has portions thereof shown, in section, to better illustrate the invention.

With reference to the drawing, there is shown an F-type rotary railroad car coupler assembly 5 which comprises the essential components of a striker 6, a yoke 7, and a car coupler 8 which includes an AAR Standard F-type coupler head 9 with an attached shank 10 that has a butt end 11 which is rotatably mounted to the yoke 7 by any suitable means, e.g. via a pivot pin 12 that extends through vertically aligned pinholes 13, 14 in the butt end 11 of the coupler shank 10 and a rotary connector 15 which is mounted within the yoke 7 for rotation about the longitudinal axis of the yoke 7.

Figure 2:
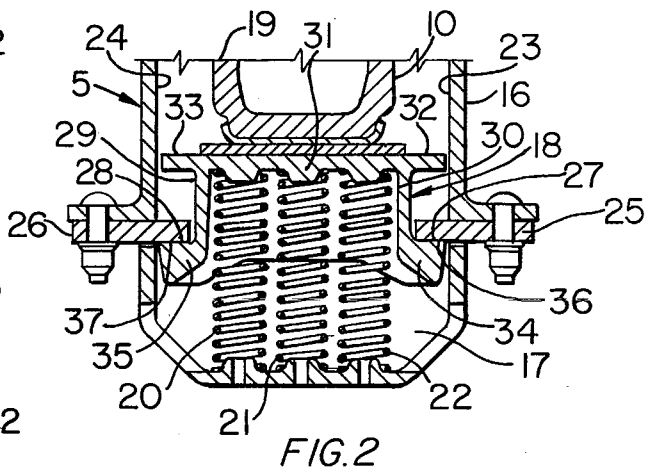
FIG. 2 is a section of the assembly viewed from the line 2—2 of FIG. 1.

The striker 6 includes a vertically extending portion or housing 16 which has a vertically elongated chamber 17 that is designed to receive a carrier 18 that is positioned to engage the underside 19 of the coupler shank 10 intermediate the butt end 11 of the coupler shank 10 and the coupler head 9, to help support the coupler head 9 during normal operation. The carrier 18 is spring loaded or biased against the coupler shank 10 by any suitable means, e.g. a plurality of vertically disposed metal coil springs 20, 21, and 22 in the chamber 17, as best seen in FIG. 2. The chamber 17 of the carrier housing 16 is defined between at least one pair of opposing sidewalls 23, 24 which are vertically disposed, when the assembly 5 is in a normal horizontal operating position. A pair of flat plates 25, 26 project horizontally into the chamber 17 from the sidewalls 23, 24 to form a pair of abutment-like stops 27, 28 in the chamber 17.

THE INVENTION

Figure 3:
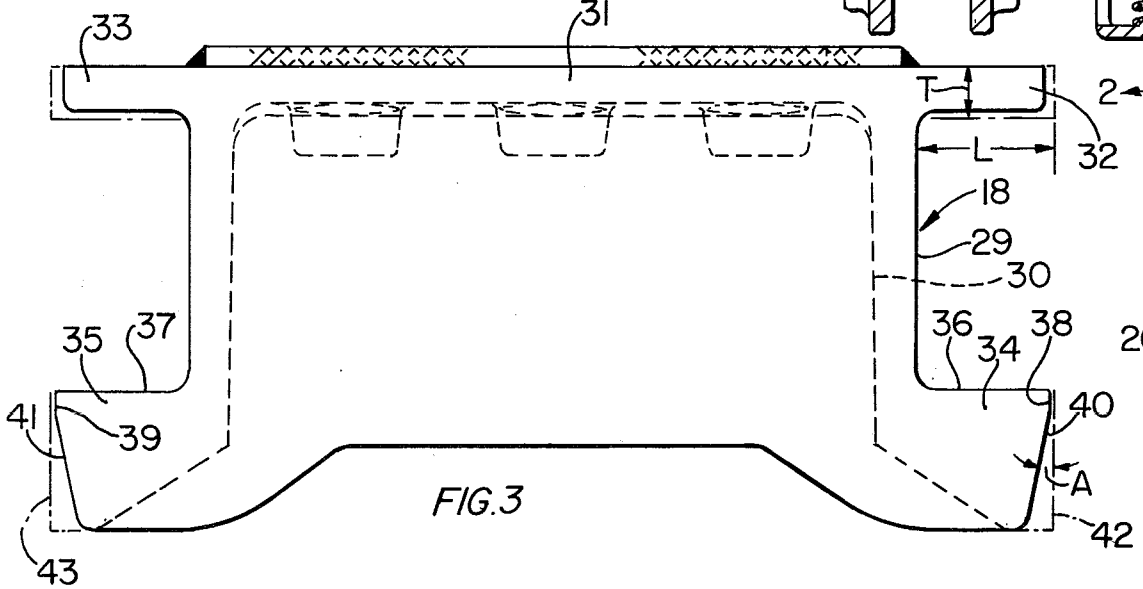
FIG. 3 is an enlarged side view of the improved carrier for comparison with an AAR Standard carrier shown in dotted line.

The improved carrier 18 of the invention, as best seen in FIGS. 2 and 3, comprises a generally rectangular body portion 29 that has a centrally disposed opening or compartment 30 which is covered by a generally rectangular top plate 31 that has a pair of laterally extending wings 32, 33 which are cantilevered over opposing sides of the body portion 29. A pair of lugs 34, 35 extend from the same opposing sides of the rectangular body portion 29 in parallel relation to the wings 32, 33 of the top plate 31. The lugs 34, 35 have a pair of coplanar, flat shoulders 36, 37 which are parallel to the top plate 31 and which are designed to engage the stops 27, 28 to maintain the carrier 18 in the chamber 17 of the striker housing 16. The lugs 34, 35 have free distal ends 38, 39 which are flat and normal to the flat shoulders 36, 37 and, as best seen in FIG. 2, terminate in close parallel proximity to the sidewalls 23, 24 of the striker housing 16. The flat ends 38, 39 of the lugs 34, 35 measure about one-quarter inches in a direction normal to the plane of the shoulders 36, 37. A pair of planar sides 40, 41 extend from the flat ends 38, 39 in converging relation in a direction away from the top plate 31, or coupler shank 10, as seen in FIG. 2. Similar planar sides 42, 43 of an AAR Standard carrier are parallel and spaced one-eighth inches wider apart, as shown in dotted line in FIG. 3, and generally parallel the sidewalls 23, 24 of the striker housing 16. The included angle A between each of the converging sides 40, 41 of the lugs 34, 35 of the carrier 18 and adjacent sidewalls 23, 24 of the striker housing 16, is about 10° to permit slight angling or tilting of the carrier 18 without impeding its vertically downward movement in the chamber 17 in response to rotation of the car coupler 8. Expressed differently, the included angle A between a pair of intersecting planes containing the converging sides 40, 41 of the lugs 34, 35 of the carrier 18 is about 20°. To help in the tilting of the carrier 18, the cantilevered length L of each of the wings 32, 33 of an AAR Standard carrier was decreased by about one-eighth inches, as shown in FIG. 3, so that the wings 32, 33 and adjacent sidewalls 23, 24 of the striker housing 16 are spaced apart about one-quarter inches.

It was also noticed that, at times, an AAR Standard carrier 18 would bottom out on the striker housing 16, i.e. the top plate 31 would engage the upper surface 44 of the striker housing 16, as best seen in FIG. 1. To alleviate this, the thickness T of the wings 32, 33 of the top plate 31 of an AAR Standard carrier 18 was decreased by about one-eighth inches, or from five-eighth inches to one-half inches, as seen in FIG. 3.

Thus, there has been described a new improved carrier which will not become momentarily frozen within the chamber of the striker which houses the carrier, as happens with existing AAR Standard carriers. The lugs, 34, 35 of the carrier 18 are provided with flats 38, 39 to insure smooth sliding action of the carrier 18 within the chamber 17 of the striker housing 16, since these points of the carrier 18 would wear quickly, if such flats were eliminated by extending the sloping sides of the lugs to the flat shoulders 36, 37. The provision of the sloping sides on the lugs of the carrier has no adverse effect upon the slidability of the carrier within the striker housing 16 when, for example, the improved carrier is used in conjunction with a non-rotary railroad car coupler assembly.

What is claimed:

1. A railroad car coupler assembly comprising:

a yoke;

a car coupler having a coupler head and a coupler shank;

means for mounting a butt end of said coupler shank within said yoke;

a striker having a central aperture through which said coupler shank extends, said striker also having an elongated chamber including a pair of sidewalls and a pair of opposing stops which extend inwardly from said sidewalls into said chamber; and, a carrier for resiliently supporting said coupler shank, said carrier being slidably received within said striker chamber and being spring loaded against said coupler shank, said carrier including a pair of aligned oppositely outward extending lugs for engaging the underside of said chamber stops to maintain said carrier in said chamber and a pair of aligned oppositely outward extending wings disposed in spaced parallel relation to said lugs, said lugs each having a sloping side portion which slopes away from a respective adjacent chamber sidewall in a direction away from said coupler shank, said lugs extending further outwardly from said carrier than said wings so as to be spaced closer to said chamber sidewalls and said side portions of said lugs being sloped at sufficient angles for allowing limited tilting of said carrier within said chamber around an axis longitudinally bisecting said car coupler.

2. The railroad car coupler assembly of claim 1, wherein the lugs have flat coplanar portions for engaging the stops, and flat end portions between the planar portions and said sloping side portions, said flat end portions being relatively short compared to said sloping side portions and being substantially parallel to the adjacent confronting sidewalls of the chamber.

3. The railroad car coupler assembly of claim 1, wherein the carrier includes a body portion extending from the lugs in the direction of the coupler shank, and a top plate covering the body portion closest the coupler shank, the plate having a pair of wings which overhang the body portion and terminate in spaced relation from the sidewalls of the striker.

4. The railroad car coupler assembly of claims 1 or 3, wherein the mounting means includes means for rotatably mounting the butt end of the shank within the yoke, so that the coupler is free to rotate about its longitudinal axis.

5. A carrier adapted to be received in a vertically elongated chamber of a striker in a rotary railroad car coupler assembly when the striker is disposed in a normal horizontal operating position, said carrier comprising:

a body portion;

a top plate covering said body portion and having a pair of oppositely extending wings which are in cantilevered relation to the opposite sides of said body portion; and, a pair of lugs which extend oppositely outward from the opposite sides of said body portion in spaced parallel relation to and a distance greater than said top plate wings, whereby said lugs are adapted to be more closely spaced toward the opposed sidewalls of an associated striker chamber when said carrier is inserted thereinto, said lugs further including flat side portions which slope toward each other in a direction away from said top plate, whereby said carrier is adapted to have the capability of limited tilting within an associated striker chamber around an axis longitudinally bisecting the associated railroad car coupler assembly, said tilting serving to accommodate the rotation of the car coupler assembly and preventing a binding of said carrier within the chamber.

* * * * *